US007060898B1

(12) United States Patent
Gretz

(10) Patent No.: US 7,060,898 B1
(45) Date of Patent: Jun. 13, 2006

(54) REMOVABLE PLUG FOR CORD OPENING OF ELECTRICAL BOX

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 11/342,942

(22) Filed: Jan. 30, 2006

(51) Int. Cl.
*H01R 13/46* (2006.01)

(52) U.S. Cl. ..... 174/53; 174/48; 174/50; 174/65 G; 439/76.1; 138/108

(58) Field of Classification Search ..... 174/53, 174/48, 50, 65 G; 439/76.1, 535, 650, 538; 138/108, 109; 411/548, 549
See application file for complete search history.

(56) References Cited

U.S. PATENT DOCUMENTS

| | | | | |
|---|---|---|---|---|
| 3,991,446 | A * | 11/1976 | Mooney et al. | 411/548 |
| 4,798,916 | A | 1/1989 | Engel et al. | |
| 6,348,657 | B1 | 2/2002 | Haslock et al. | |
| 6,360,493 | B1 | 3/2002 | Torres, III | |
| 6,921,861 | B1 | 7/2005 | Gretz | |

* cited by examiner

*Primary Examiner*—Dhiru R. Patel

(57) ABSTRACT

A removable plug for closing an unused cord opening on an electrical box. The cord opening is typically a U-shaped slot extending from the side of an electrical box or side of the cover member. The plug includes a main body, inner arms and outer arms that define a channel therebetween. The channel has a width slightly greater than the walls of an electrical box that it will be used in conjunction with. The plug may be used to plug any unused cord openings to prevent the entry of insects into the electrical box. The plug can be removed or reinserted as desired to protect any unused cord openings.

5 Claims, 6 Drawing Sheets

REMOVABLE PLUG FOR CORD OPENING OF ELECTRICAL BOX

FIELD OF THE INVENTION

This invention relates to electrical boxes and specifically to a removable plug for closing the unused cord openings on an electrical box or an electrical box cover in order to protect the box from unwanted entry by insects.

BACKGROUND OF THE INVENTION

Electrical boxes are commonly mounted on the exterior walls of buildings to provide electrical devices such as duplex receptacles or outlets to service various electrical equipment. One of the more popular electrical boxes for exterior applications includes what is termed as "in-use cover". An in-use cover is one that can be kept closed on the electrical box even while the electrical outlets mounted therein are in use, or have electrical cords plugged into them. This is typically accomplished by providing cord openings within either the box or the cover member of the electrical box.

Although in-use covers adequately protect the electrical device within the box from rain, snow, and other falling items, they do not adequately protect the device from other hazards, such as insects. When a cord opening is not occupied by an electrical cord, the cord opening becomes an open pathway to allow entry of various insects into the electrical box. Insects can compromise any electrical box, as wasps and other stinging insects tend to build nests in enclosed spaces and spiders typically spin webs. All of these can make it hazardous or simply unpleasant for the home-owner when he wishes to access an electrical box that has been occupied by insects.

What is needed therefore is a device for preventing insects from infiltrating the unused cord openings on an in-use electrical box.

SUMMARY OF THE INVENTION

The invention is a removable plug for closing the cord opening of an electrical box. The cord opening is typically a substantially U-shaped slot extending from the side of an electrical box or from the side of a cover member. The plug includes a main body, inner arms, and outer arms that define a channel therebetween. The channel has a width slightly greater than the walls of an electrical box that it will be used in conjunction with. The plug may be used to plug any unused cord openings to prevent the entry of insects into the electrical box. The plug can be removed or reinserted as desired to protect any unused cord openings.

OBJECTS AND ADVANTAGES

A first advantage of the removable plug of the present invention is that it seals any unused cord openings on an in-use electrical box.

Another advantage of the removable plug of the present invention is that it provides protection against insects to the electrical box and any electrical device installed therein.

A further advantage of the removable plug of the present invention is that it is easily removable. Any plug that has been previously installed can be easily removed by simple hand pressure.

A further advantage of the removable plug of the present invention is that it is easily manufactured in one piece.

These and other objects and advantages of the present invention will be better understood by reading the following description along with reference to the drawings.

TABLE OF NOMENCLATURE

Figure 1:
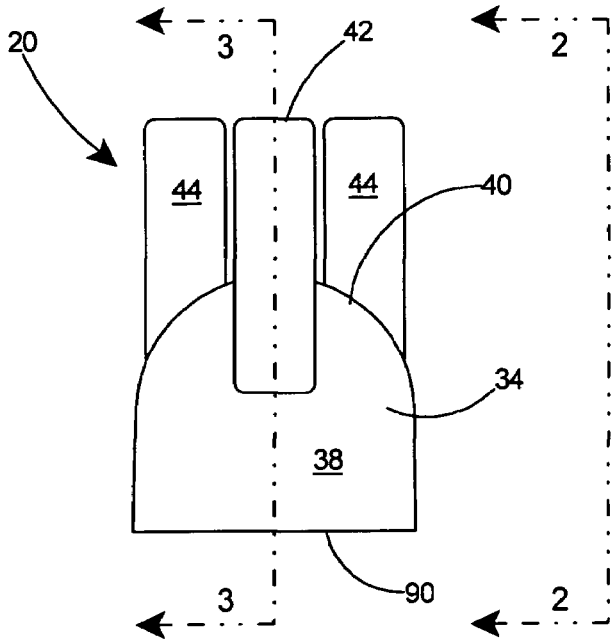
FIG. 1 is a front view of a preferred embodiment of a removable plug for an electrical box according to the present invention.
Figure 2:
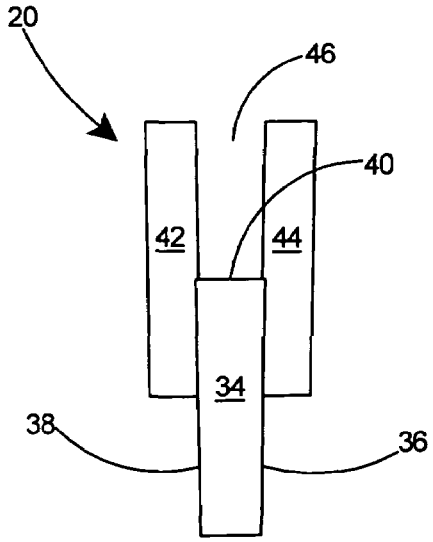
FIG. 2 is side view of the removable plug taken along line 2–2 of FIG. 1.

The following is a listing of part numbers used in the drawings along with a brief description:

| Part Number | Description |
|---|---|
| 20 | removable plug, preferred embodiment |
| 22 | opening in cover |
| 24 | cover |
| 26 | electrical box |
| 28 | opening in electrical box |
| 30 | sidewall |
| 32 | electrical box |
| 34 | central body |
| 36 | inner side |
| 38 | outer side |
| 40 | top periphery |
| 42 | outer arm |
| 44 | inner arm |
| 46 | channel |
| 48 | side of channel |
| 50 | top of channel |
| 52 | bottom of channel |
| 53 | recessed electrical box |
| 54 | electrical outlet |
| 56 | removable plug, second embodiment |
| 58 | outer arm |
| 60 | inner arm |
| 62 | channel |
| 64 | top of channel |

-continued

| Part Number | Description |
|---|---|
| 66 | bottom of channel |
| 68 | tab |
| 70 | sidewall of cover |
| 72 | two-way opening electrical box cover assembly |
| 74 | outer cover member |
| 76 | middle member |
| 78 | base member |
| 82 | gasket |
| 84 | electrical box |
| 86 | face plate |
| 88 | duplex outlet |
| 90 | flat bottom end |
| 92 | edge of cover |
| W1 | width of channel at bottom |
| W2 | width of channel at top |
| W3 | width of channel at tab |
| W4 | width of channel away from tab |

DETAILED DESCRIPTION OF THE INVENTION

The present invention comprises a removable plug for closing an opening on an electrical box. The removable plug is especially useful for closing the cord openings on an in-use electrical box to keep insects out while the cord opening is does not have a cord running there through.

Figure 8:
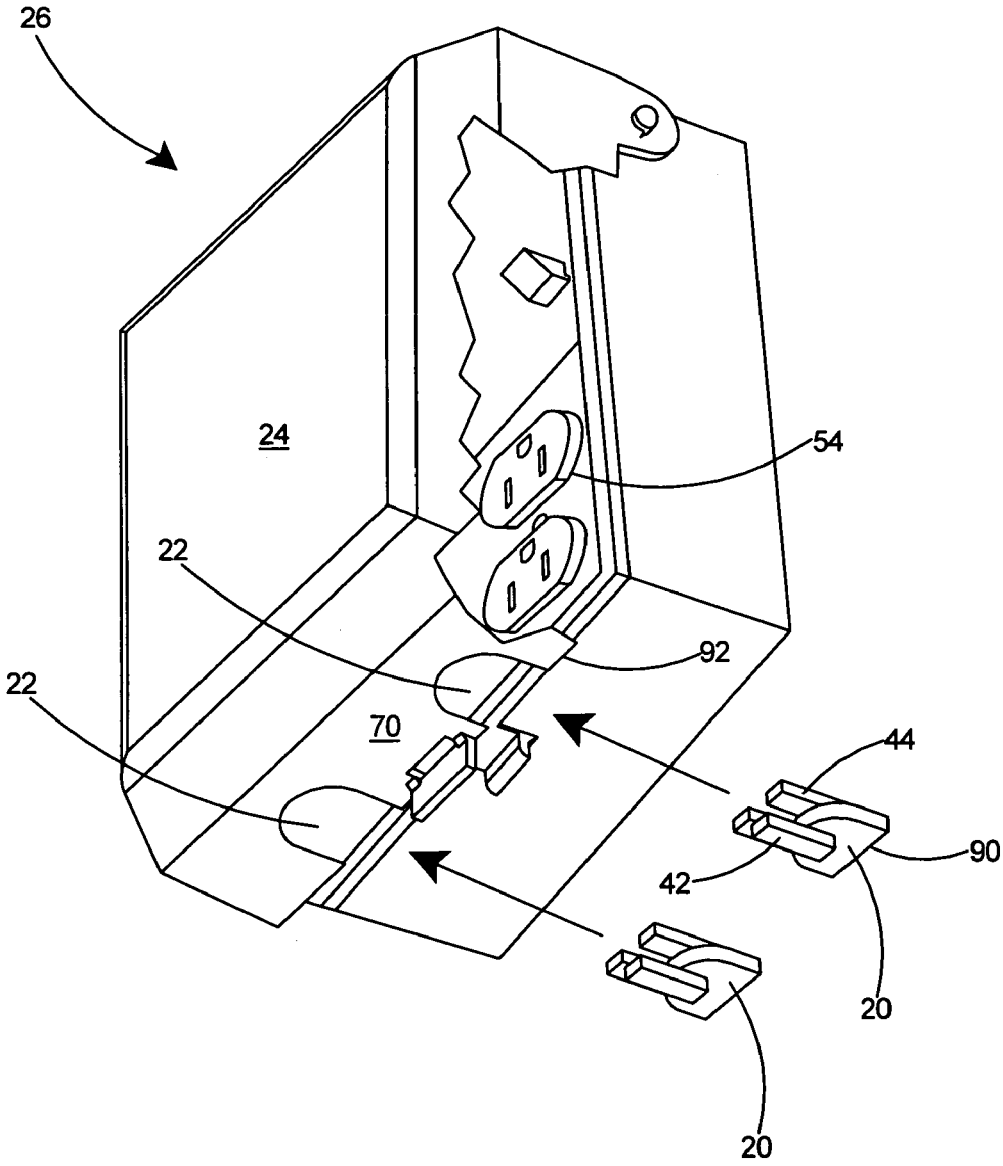
FIG. 8 is a perspective view of a portion of an electrical box with a bottom corner of the cover cut away and with two of the removable plugs of FIG. 1 exploded away and in alignment to be inserted in cord openings in the cover member.
Figure 11:
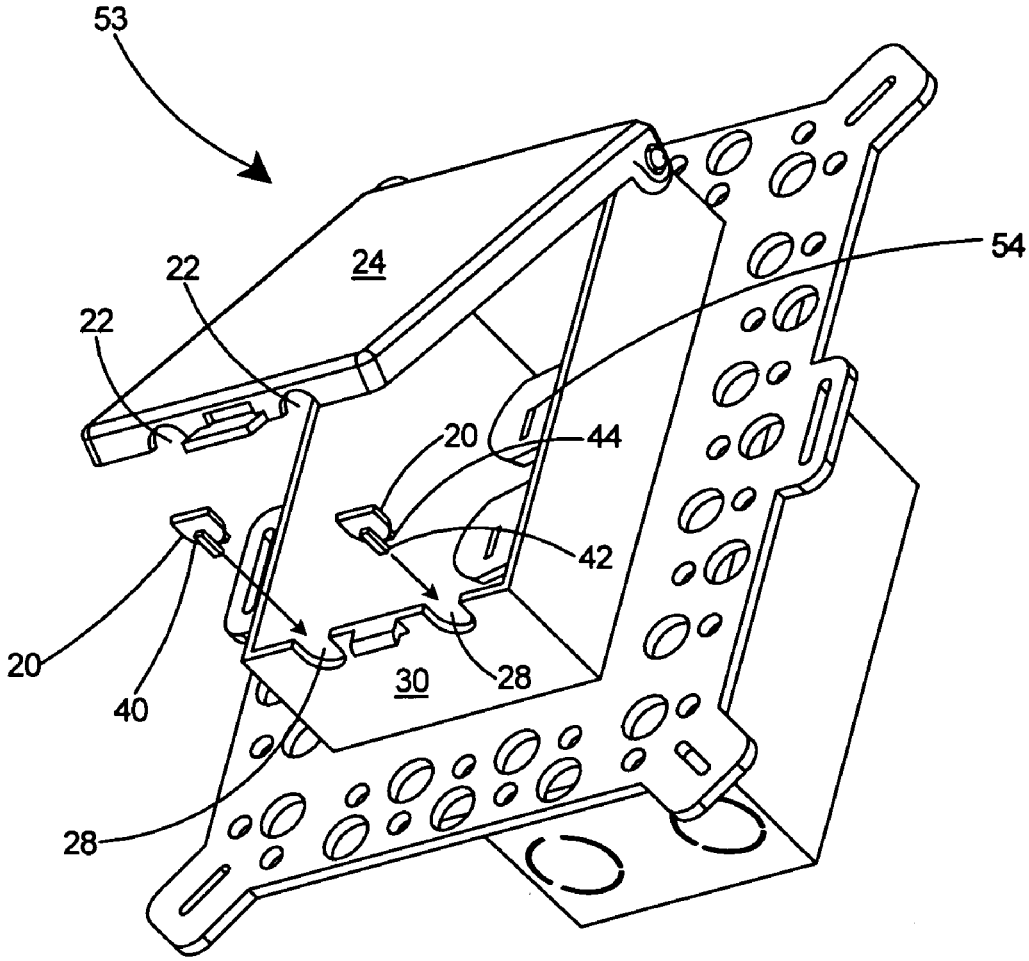
FIG. 11 is a perspective view of a portion of a recessed electrical box shown with the cover open and with two of the removable plugs of FIG. 1 exploded away and in alignment to be inserted in cord openings in the electrical box.

With reference to FIG. 8, there is shown the preferred embodiment of a removable plug 20 for closing an opening on an electrical box cover. FIG. 8 depicts the removable plugs 20 in alignment to be inserted in openings 22 in the cover 24 of an electrical box 26. FIG. 11 depicts the removable plugs 20 in alignment to be inserted in openings 28 in the sidewall 30 of a recessed electrical box 53.

Figure 3:
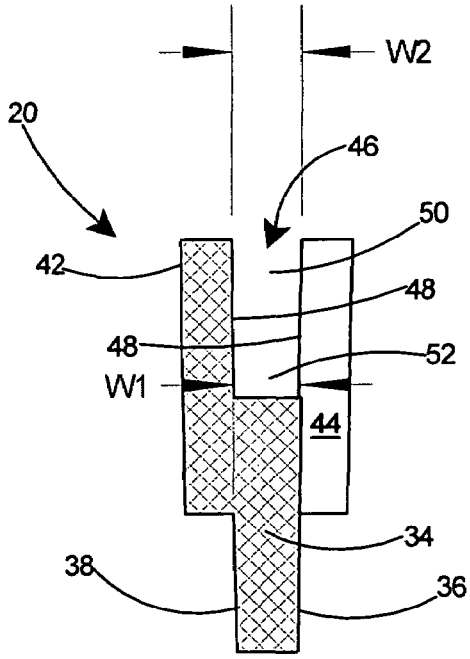
FIG. 3 is a section view of the removable plug taken along line 3–3 of FIG. 1.
Figure 4:
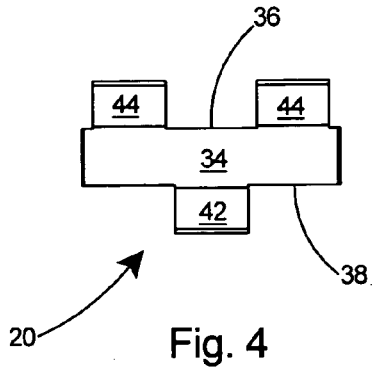
FIG. 4 is a top view of the removable plug of FIG. 1.
Figure 5:
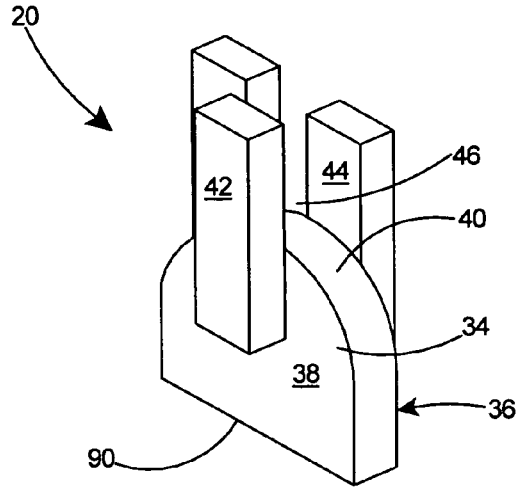
FIG. 5 is a perspective view of the removable plug of FIG. 1.

Referring to FIGS. 1–5, the removable plug 20 includes a central body 34 with an inner side 36, an outer side 38, and a top periphery 40. An outer arm 42 extends from the top periphery 40 at the outer side 38 and two inner arms 44 extend from the top periphery 40 at the inner side 36. As shown in FIGS. 3 and 4, a channel 46 extends along the top periphery 40 and is defined by the inner arm 44 and the outer arm 42. The top periphery 40 of the central body 34, as shown in FIGS. 1 and 5, is substantially U-shaped, with the top periphery 40 an inverted U shape with the removable plug 20 oriented as shown in FIGS. 1 and 5

With reference to FIG. 3, the channel 46 of the removable plug 20 includes two sides 48, a top 50, and a bottom 52. The top 50 of the channel 46 is slightly wider than the bottom 52 of the channel 46 and the channel 46 slopes evenly on each side 48 from the top 50 to the bottom 52 thereby gradually narrowing the channel from the top 50 to the bottom 52. Preferably, the width W1 of the bottom 52 of the channel 46 is between 0.010 and 0.030 inch narrower than the width W2 of the top 50 of the channel 46.

With reference to the recessed electrical box in FIG. 11, the removable plug 20 may be installed in a cord opening 28 on a sidewall 30 of the recessed electrical box 53 to close off the cord opening 28 when it is not in use. The recessed electrical box 53 includes cord openings 22 in the cover 24 and cord openings 28 in the electrical box 53, which overlap when the cover 24 is closed upon the electrical box 53. When the removable plug 20 is inserted in the cord opening 28 and the cover 24 is closed upon the electrical box 53, the any plugs 20 that are installed will block the entire cord opening 28. There will be no open space between the closed cover 24 and the cord opening thus sealed by the inserted plug 20. The cord opening 28 is in use when an electrical cord (not shown) extends through the opening 28, such as when the electrical cord is plugged into one of the electrical outlets 54 of the electrical box 53. Sliding the removable plugs 20 into the openings 28 in the sidewall 30 in the direction of the arrows enables a friction fit of the removable plug 20 in the opening 28 with the inner arm 44 and the outer arm 42 holding frictionally thereon onto the sidewall 30. The opening 28 in the sidewall 30 is preferably U-shaped. The top periphery 40 of the central body 34 is U-shaped to match the shape of the opening 28 in the sidewall 30 of the electrical box 53 and thereby provide a close fit within the opening 28 with no gaps or holes when the plug 20 is fully installed therein. Details of the recessed electrical box can be found in U.S. Pat. No. 6,921,861, which is incorporated herein in its entirety by reference.

Figure 9:
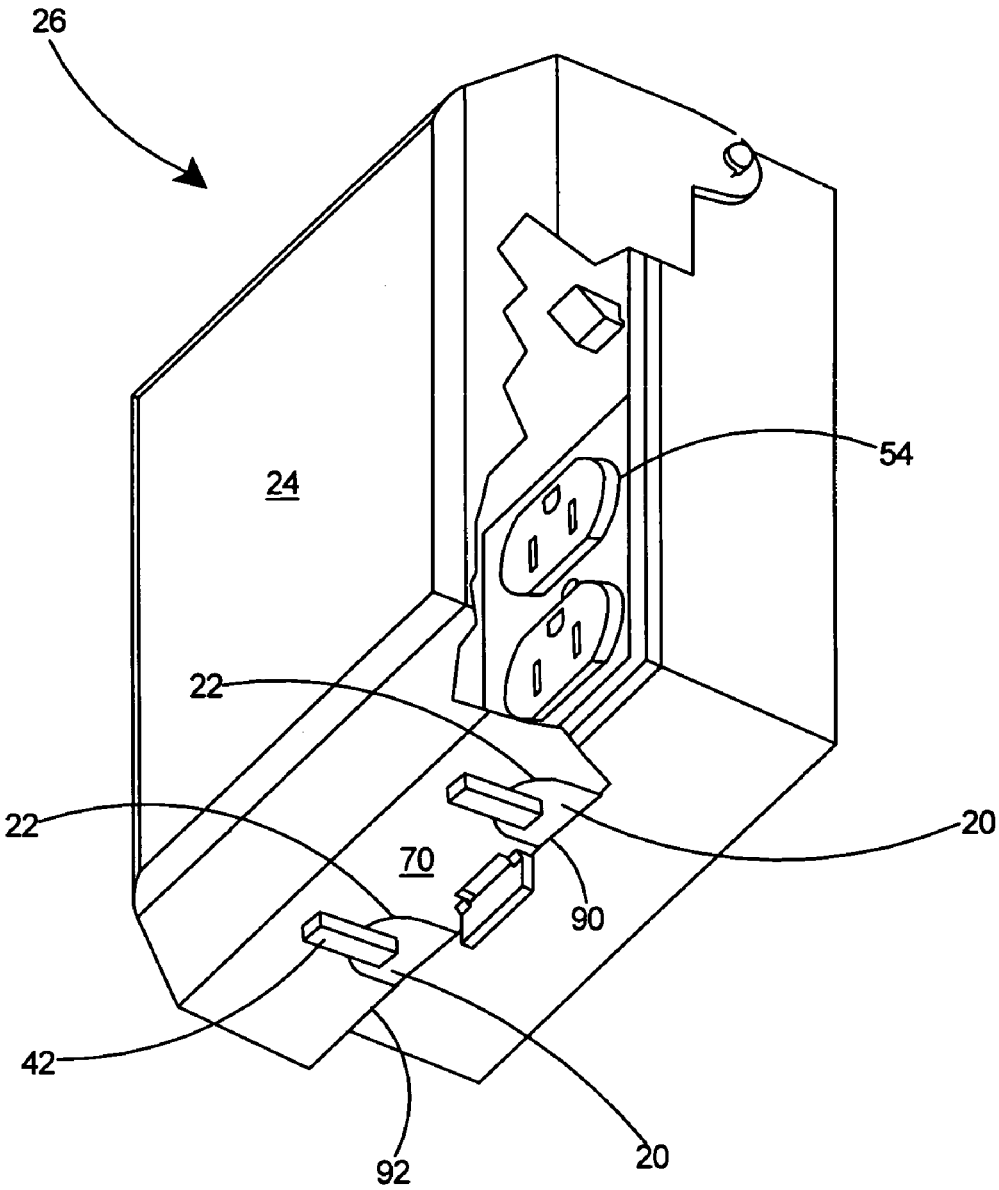
FIG. 9 is a perspective view of the electrical box of FIG. 8 with the two removable plugs installed in cord openings in the cover.

Referring to the electrical box in FIG. 8, the removable plug 20 may also be installed in a cord opening 22 on the cover 24 of an electrical box 26 to close off the cord opening 22 when it is not in use. With reference to FIG. 9, after being installed in the cord openings 22 on the cover 24, the removable plugs 20 protect the interior of the electrical box 26 and the electrical outlet 54 therein from insects and the like which typically could enter and build nests or otherwise compromise the interior of the box. When one or more electrical cords (not shown) are connected to the electrical outlet 54, one or both of the plugs 20 may be removed by simply pulling them out of the openings 22. Since they are held by a frictional fit as a result of the narrowing channel 46 gripping the sidewalls 70 of the cover 24, the plugs 20 can be easily removed by grasping them and pulling them out. If the electrical cord is again removed from the electrical outlet 54, the plugs 20 can be reinstalled by simply aligning them with the openings 22 and pushing them in.

Figure 6:
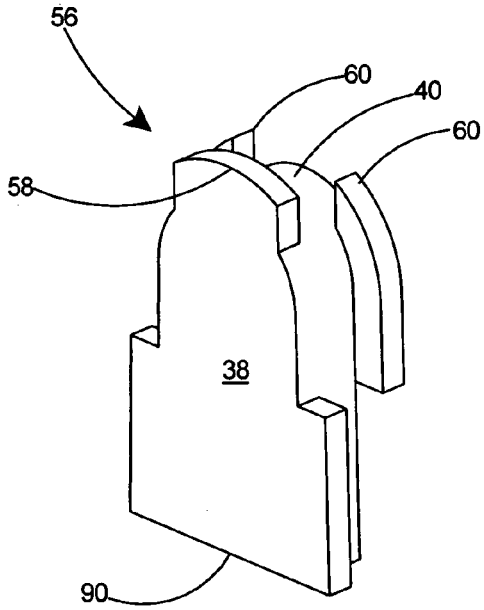
FIG. 6 is a perspective view of a second embodiment of a removable plug for an electrical box according to the present invention.
Figure 7:
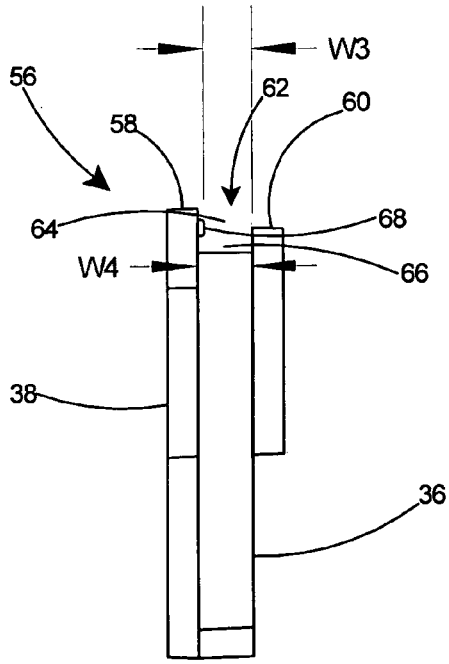
FIG. 7 is a side view of the removable plug of FIG. 7.

With reference to FIGS. 6 and 7, a second embodiment of a removable plug 56 is depicted. The removable plug 56 includes an outer arm 58 and inner arms 60 defining, as shown in FIG. 7, a channel 62 there between. The channel 62 includes a top 64 and a bottom 66. A tab 68 extends into the channel 62 and narrows the channel 62 at the tab 68. Preferably, the width W3 of the of the channel 62 at the tab 68 is between 0.010 and 0.030 inch narrower than the width W4 of the channel 62 away from the tab 68.

Figure 10:
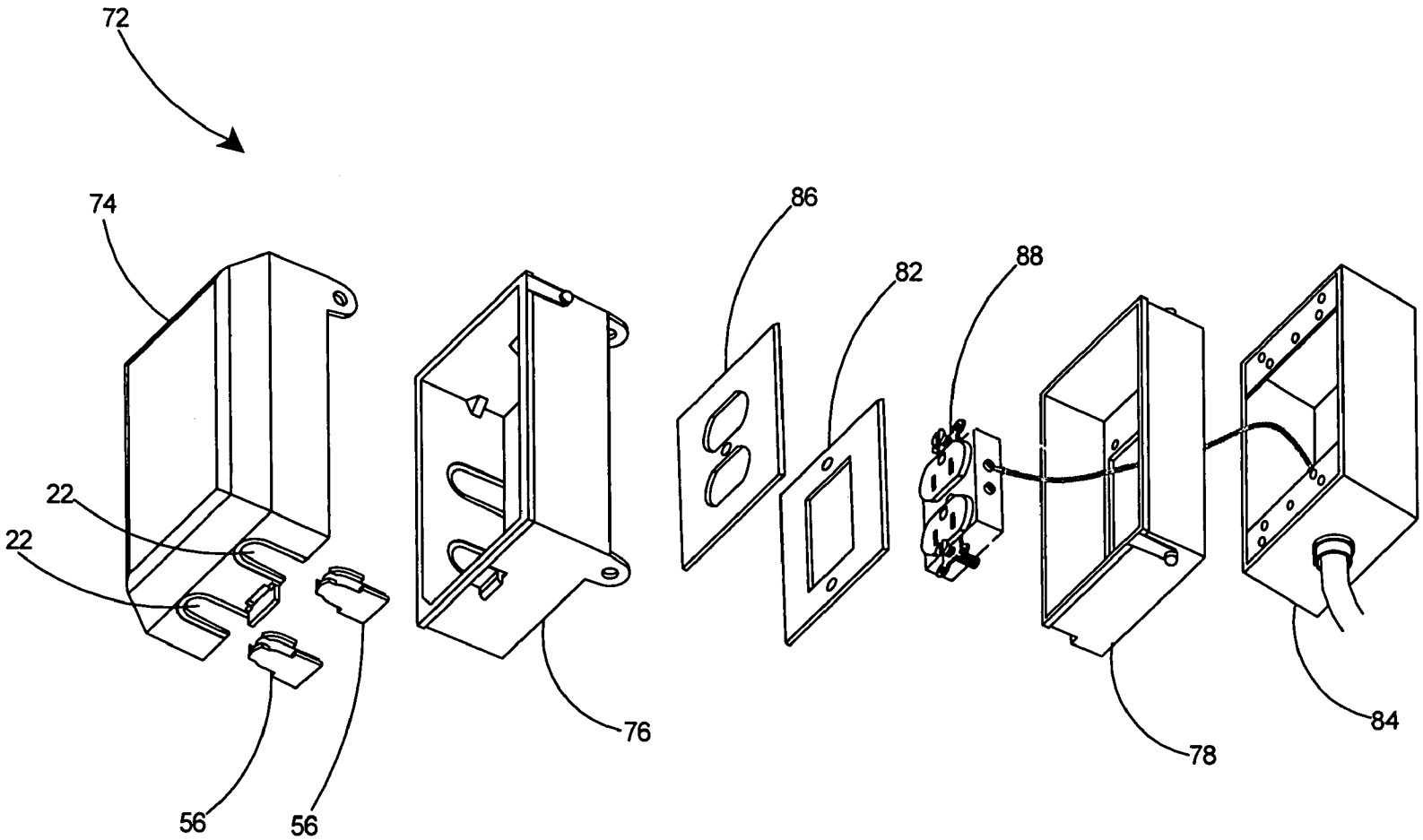
FIG. 10 is an exploded perspective view of a two-way electrical box cover assembly, an electrical box, an electrical device, a faceplate and two of the removable plugs of FIG. 6 shown exploded away and in alignment to be inserted in cord openings in the cover member.

Operation of the second embodiment of the removable plug is analogous to that of the first embodiment. With reference to FIG. 10, a two-way opening electrical box cover assembly 72 is depicted with two removable plugs 56 aligned and ready to be inserted in the cover 74 of the electrical box 72. The two-way opening cover assembly 72 includes an outer cover member 74, a middle member 76, a base member 78, and, if required, a gasket 82. The two-way opening cover assembly 72 works in conjunction with a standard electrical box 84 and a standard face plate 86 to house an electrical device therein, such as the duplex outlet 88 shown. One or both of the plugs 56 can be installed in the openings 22 in the cover 74 to close off the cord openings 22 when they are not in use. If a cord opening 22 is placed in use, the removable plugs 56 can be easily removed by grasping each plug 56 and pulling it out of the opening 22. Details of the two-way electrical box cover assembly can be found in U.S. Pat. No. 6,921,861, which is incorporated herein in its entirety by reference.

With reference to FIGS. 5 and 6, the removable plugs 20 and 56 disclosed herein are preferably molded in one piece from plastic. Thus, with reference to the first and preferred embodiment as shown in FIG. 5, the central body 34, outer arm 42, and inner arm 44 are molded from plastic as a unit.

The removable plugs as disclosed herein may be used to plug a cord opening on either a cover member or on an electrical box, as the cord opening may be formed on one or the other. As disclosed herein and shown in FIGS. 5 and 6, the top peripheries 40 of removable plugs 20 and 56 are preferably U-shaped to fit the U-shaped cord opening 28 in an electrical box or the U-shaped cord opening 22 in its cover 24 (see FIG. 8). Although the particular embodiment shown here depicts U-shaped cord openings, it should be understood that other shaped openings, such as rectangular or square, can easily be accommodated by varying the shape of the top periphery 40 of the removable plugs to match the shape of the openings in the cover or in the electrical box. With reference to FIGS. 5 and 6, removable plugs 20 and 56 further include a flat bottom end 90 to allow the bottom end to line up essentially even with the edge 92 (see FIG. 8) of the cover 24 or electrical box having the openings 28 therein.

The removable plugs disclosed herein provide a method of closing an opening on an electrical box. With reference to FIG. 5, the method involves providing a removable plug 20 including a central body 34, an inner side 36, an outer side 38, a top periphery 40, an outer arm 42 extending from the top periphery 40 along the outer side 38, an inner arm 44 extending from the top periphery 40 along the inner side 36, and a channel 46 along the top periphery 40 defined by the inner arm 44 and the outer arm 42. The removable plug 20 is used to close the cord opening 22 (see FIG. 8) in a cover 24 or the cord opening 28 in an electrical box 53 (see FIG. 11). The method includes inserting the removable plug 20 into the opening 22 until the top periphery 40 of the plug contacts the sidewall 70.

Having thus described the invention with reference to a preferred embodiment, it is to be understood that the invention is not so limited by the description herein but is defined as follows by the appended claims.

What is claimed is:

1. A removable plug for closing an opening on an electrical box or an electrical box cover comprising:

a central body having an inner side, an outer side, and a top periphery;

an outer arm extending from said top periphery at said outer side;

an inner arm extending from said top periphery at said inner side;

a channel along said top periphery defined by said inner arm and said outer arm;

said channel includes two sides, a top portion, and a bottom portion;

said top portion of said channel is slightly wider than said bottom portion of said channel; and said channel slopes evenly on each side from said top portion to said bottom portion thereby gradually narrowing said channel from said top portion to said bottom portion of said channel.

2. The removable plug of claim 1 wherein said bottom portion is narrower than said top portion by between 0.010 and 0.030 inch.

3. A removable plug for closing an opening on an electrical box or an electrical box cover comprising:

a central body having an inner side, an outer side, and a top periphery;

an outer arm extending from said top periphery at said outer side;

an inner arm extending from said top periphery at said inner side;

a channel along said top periphery defined by said inner arm and said outer arm;

a tab on at least one of said arms; and said tab extending into said channel and narrowing said channel at said tab.

4. The removable plug of claim 3 wherein said channel at said tab is narrower than said channel by between 0.010 and 0.030 inch.

5. The removable plug of claim 3 including a sidewall on said electrical box; and a U-shaped opening in said sidewall of said electrical box;

whereby sliding said removable plug into said U-shaped opening enables a friction fit of said removable plug in said U-shaped opening with said tab, said inner arm, and said outer arm holding said sidewall frictionally therebetween.

* * * * *